US006388446B1

(12) United States Patent
Nielsen et al.

(10) Patent No.: US 6,388,446 B1
(45) Date of Patent: May 14, 2002

(54) ENGINE IGNITION TIMING TOOL

(75) Inventors: Paul E. Nielsen, 2645 Matthew Road, Nanoose Bay, BC (CA), V9P 9B2; John E. Nielsen, Nanaimo (CA)

(73) Assignee: Paul E. Nielsen, Nanoose Bay (CA)

( * ) Notice: Subject to any disclaimer, the term of this patent is extended or adjusted under 35 U.S.C. 154(b) by 0 days.

(21) Appl. No.: 09/501,842

(22) Filed: Feb. 10, 2000

(30) Foreign Application Priority Data

Feb. 10, 1999 (CA) ..... 2261455

(51) Int. Cl.[7] ..... F02P 17/00
(52) U.S. Cl. ..... 324/391; 123/90
(58) Field of Search ..... 123/90, 62; 324/391, 324/392

(56) References Cited

U.S. PATENT DOCUMENTS

| | | | |
|---|---|---|---|
| 1,846,153 | A | 2/1932 | Sherman |
| 2,043,931 | A | 6/1936 | Morgan |
| 2,057,968 | A | 10/1936 | Paxton |
| 2,064,093 | A | 12/1936 | Walters |
| 2,611,837 | A | 9/1952 | Zirin |
| 2,837,713 | A | 6/1958 | Schoenleber |
| 3,474,667 | A | 10/1969 | Fuchs |
| 3,857,086 | A | 12/1974 | Mooney et al. |
| 3,906,917 | A | 9/1975 | Lorti |
| 4,177,781 | A | 12/1979 | Marchelletta et al. |
| 4,344,391 | A | 8/1982 | Mizutani et al. |
| 4,384,481 | A | 5/1983 | Simosato |
| 4,444,171 | A | 4/1984 | Baxter |
| 4,489,498 | A | 12/1984 | Christophersen |
| 4,580,446 | A | 4/1986 | Ansteth |
| 5,003,945 | A | 4/1991 | Hoeptner |
| 5,105,155 | A | 4/1992 | Boaze |
| 5,431,134 | A | 7/1995 | Budde et al. |
| 5,814,723 | A | 9/1998 | Berardinelli |

FOREIGN PATENT DOCUMENTS

| | | |
|---|---|---|
| CA | 1093146 | 1/1981 |

*Primary Examiner*—Safet Metjahic
*Assistant Examiner*—Vincent Q. Nguyen
(74) *Attorney, Agent, or Firm*—Robert H. Barrigar

(57) ABSTRACT

An engine ignition timing tool is provided for use with a strobe timing light in setting the timing of Harley-Davidson motorcycle engines The timing display tool includes a modified circuit breaker cam bolt having a pointer indicator attachable to a cam assembly of the engine, and an ignition timing measuring plate attachable to a gear cover of the engine. The timing display tool is installed on the side of the engine having the ignition unit where the ignition timing is to be set. The engine is run and the strobe timing light is set to the engine spark firing frequency then shone onto the pointer indicator and measuring plate so that the pointer indicator is illuminated at a timing mark corresponding to the degree of spark advance or retard of the engine. The ignition timing is then adjusted.

13 Claims, 4 Drawing Sheets

Prior Art

ENGINE IGNITION TIMING TOOL

FIELD OF THE INVENTION

The present invention relates generally to an apparatus for setting the ignition timing of an internal combustion engine, and more particularly, to a tool for setting the ignition timing of Harley Davidson™-type motorcycle engines and similar engines while the engine is running.

BACKGROUND OF THE INVENTION

The conventional method of setting the ignition timing of many models of Harley Davidson™ motorcycles is time-consuming and difficult. In these models, the information needed to adjust the timing of the motorcycle engine is on the opposite side of the motorcycle from the ignition unit where timing is to be adjusted. There are indicators for piston top dead centre (TDC) and ignition timing marked on the flywheel. These indicators are viewable through a small observation port on one side of the engine, the timing indicator side. An ignition unit is mounted on the opposite side of the engine, the timing adjustment side. The ignition unit includes a circuit breaker assembly having a mechanical points mechanism and advance unit for adjusting the ignition timing.

The conventional steps for adjusting the timing of such Harley Davidson™ motorcycle engines while the engine is running, are as follows: a mechanic first determines the location of TDC of the piston compression stroke relative to the rotational position of the driveshaft; this can be accomplished by removing a sparkplug and noting when the piston reaches the TDC position. Or, the mechanic may, shine a light through the observation port onto the flywheel that is visible through the port to observe a TDC mark on that flywheel. Then, the mechanic determines the degree of spark advance relative to TDC, i.e. where the spark plug is firing relative to the position of the piston (measured in degrees of rotation where TDC is zero) as follows: a standard inductive pickup communicative with the spark plug measures the spark timing, then sets a strobe timing light frequency in time with the spark timing; when the strobe light is aimed through the observation port, it illuminates an ignition timing mark indicative of the degree of spark advance. Then, the mechanic must move to the other side of the motorcycle, i.e. the timing adjustment side, to adjust the points mechanism and advance unit to alter the spark timing (and consequently, the strobe frequency), then returns to the timing indicator side of the motorcycle to view the new timing mark. Typically, the mechanic must move from one side of the motorcycle to the other side several times to calibrate the ignition timing to the selected degree of accuracy. Obtaining accurate timing is a tedious and time-consuming process of trial and error. Because the engine is running, the mechanic is sprayed with oil coming out of the observation port every time he observes the timing mark. This method of setting the timing is inconvenient and messy.

The prior art of which the inventor is aware includes a conversion kit which replaces the points plate and advance unit of a stock ignition system with a modified points plate and modified advance unit that permits observation of a marked disk that is mounted upon the circuit breaker cam so that it rotates with the cam. As the points plate and advance unit contain a number of precision parts, the modified points plate and advance unit is relatively complex and expensive to manufacture. Therefore, it is not particularly cost-effective to replace the original functional points plate and advance unit for the purpose adjusting ignition timing.

A simple-to-use, inexpensive tool for adjusting ignition timing of Harley-Davidson and similar motorcycle engines such as S&S and Merch Performance from the ignition unit/circuit breaker side of the engine without replacing the stock circuit breaker points plate and advance unit may be preferred over the prior art by those owners of such motorcycles who prefer to set ignition timing themselves and to use stock parts for cost or availability reasons.

SUMMARY OF THE INVENTION

The present invention is directed in one aspect to providing an auxiliary ignition timing display tool (hereinafter "timing display tool") for adjusting the ignition timing of a Harley-Davidson motorcycle engine or similar engine using a strobe timing light. The timing display tool includes (1) a replacement pointer cam bolt threaded at a distal end to match the stock circuit breaker cam bolt, (2) a pointer indicator attached to the proximal end of the pointer cam bolt, (3) an ignition timing measuring plate having spaced timing marks indicating in degrees the spark position relative to TDC, and attachable to the gear cover of the engine, and (4) measuring plate fastening means for fastening the measuring plate to the engine.

To install the timing display tool, a number of parts from the engine must be temporarily removed. A circuit breaker cover and gasket is removed to expose the inside of the ignition unit and provide access to an engine timing setting adjustment device, such as a points mechanism and advance unit. A circuit breaker cam assembly bolt is removed and replaced with the pointer cam bolt, and gear cover screws are removed and replaced with the measuring plate fastening means. The measuring plate is then installed on the fastening means so that the measuring plate is positioned in front of a front rim of an engine gear cover. Then, the pointer indicator is installed on the proximal end of the pointer cam bolt.

The engine is turned on and a standard strobe timing light communicates with the ignition system to match the strobe frequency with the spark firing frequency of the engine. The strobe light is then shone on to the measuring plate to illuminate the pointer at a timing mark on the measuring plate corresponding to the spark position. The engine timing setting adjustment device may then be adjusted in the conventional manner to alter the ignition timing until the pointer points to the desired timing mark.

The prior art of which the inventor is aware includes a conversion kit which replaces the points plate and advance unit of a stock ignition system with a modified points plate and modified advance unit that permits observation of a marked disk that is mounted upon the circuit breaker cam so that it rotates with the cam. As the points plate and advance unit contain a number of precision parts, the modified points plate and advance device which when installed is operatively coupled to the ignition unit and indicates the degree of spark advance or retard relative to an engine top dead center position and provides a display of the indication viewable on the same side of the engine as that on which the engine timing setting adjustment device is located, i.e. the timing adjustment side. The display device is removably attachable to the engine housing. The timing display tool kit also includes a plurality of fasteners for releasably fastening the display device to the engine housing and positioning the display device in a preselected position suitable for coupling of the display device to the ignition unit. The display device in conjunction with the strobe timing light set at the spark firing frequency of the engine are operable to provide an indication of the ignition timing of the engine while the engine is running. If the engine has a gear cover, the display device may be removably attached to the gear cover; the fasteners when installed releasably fasten the display device to the gear cover.

DETAILED DESCRIPTION OF THE PREFERRED EMBODIMENT

Figure 1:
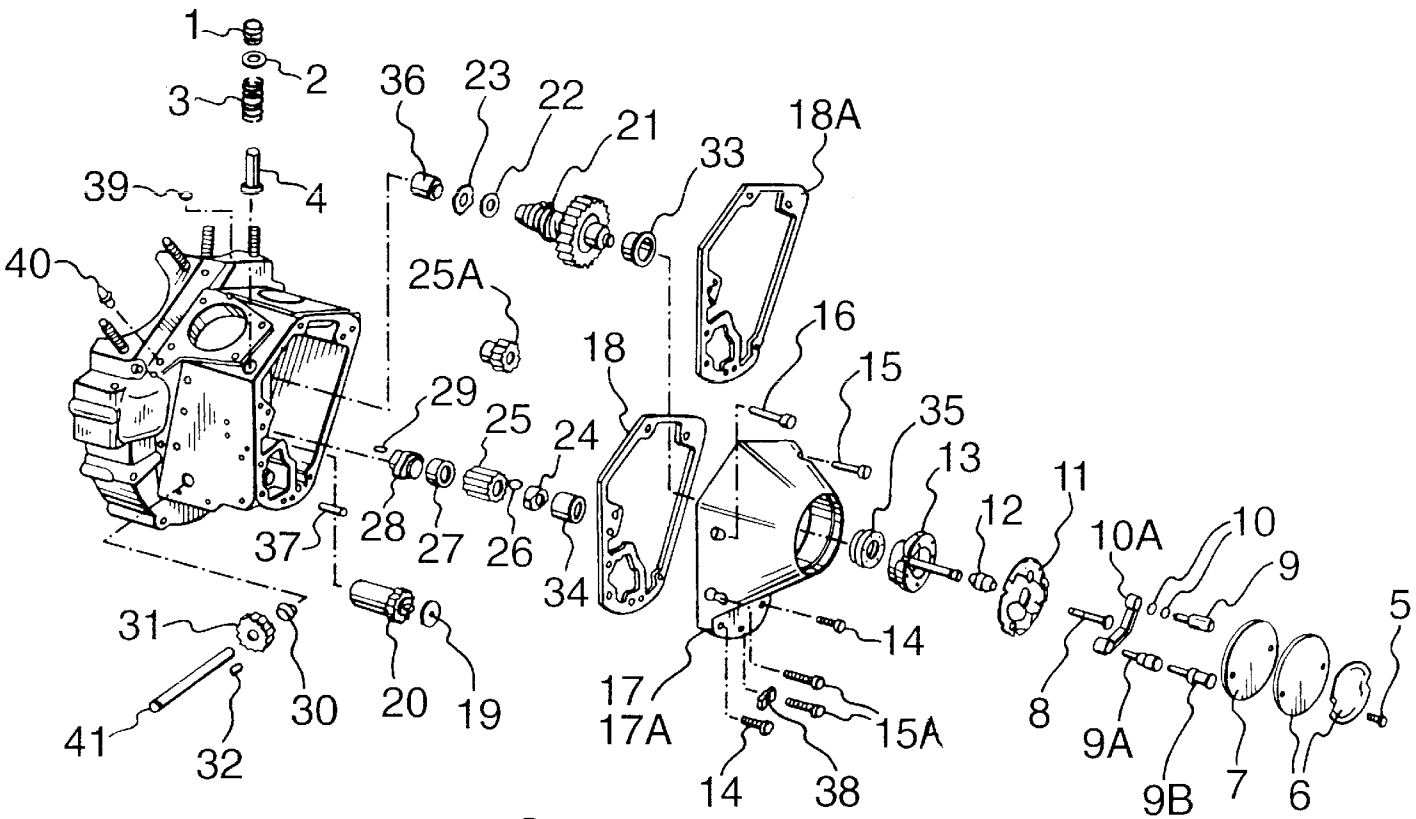
FIG. 1 is an exploded isometric view of a typical stock Harley Davidson™ motorcycle gearcase.
Figure 2:
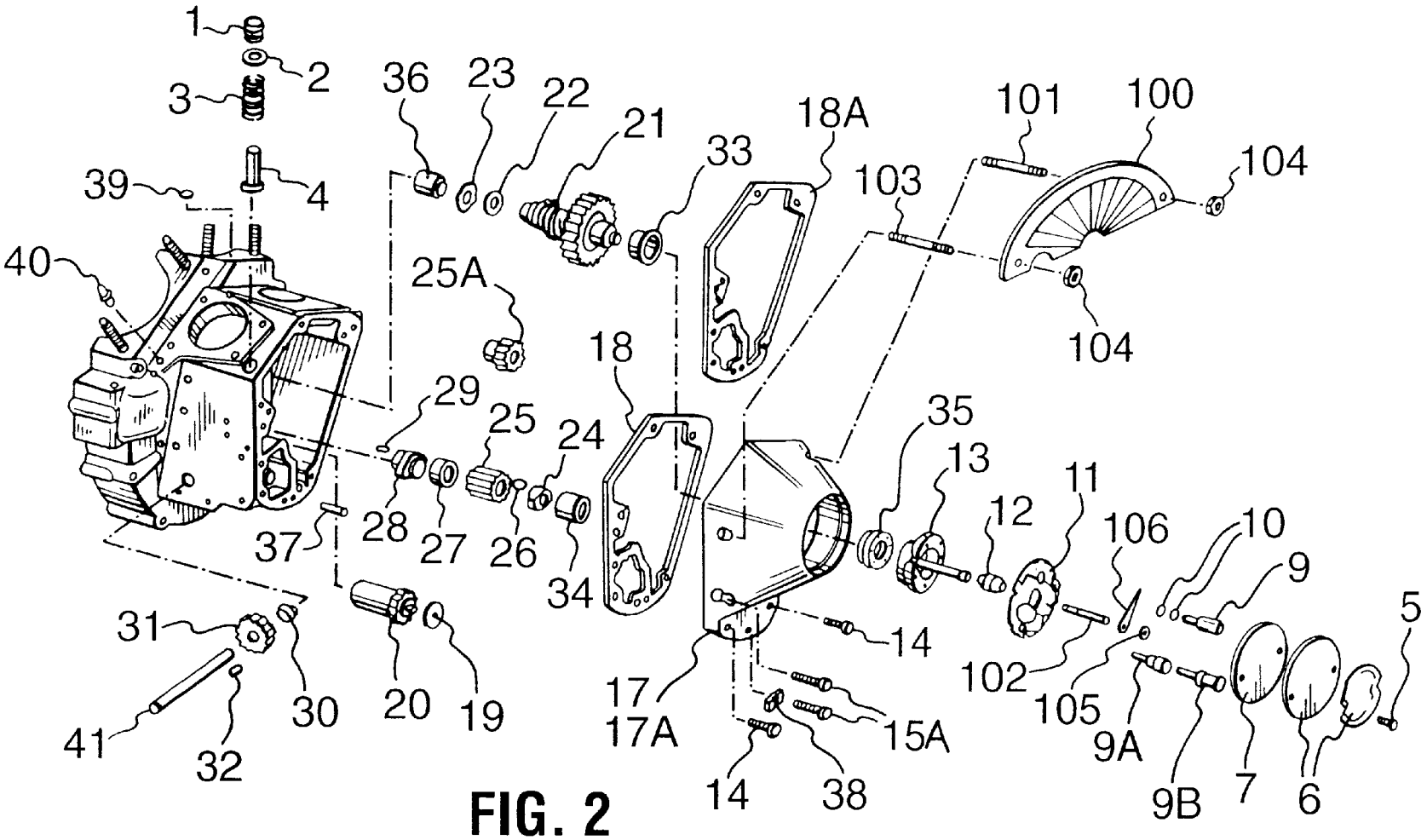
FIG. 2 is an exploded isometric view of the typical stock Harley Davidson™ motorcycle gearcase of FIG. 1 with the components of an embodiment of the invention shown.
Figure 3:
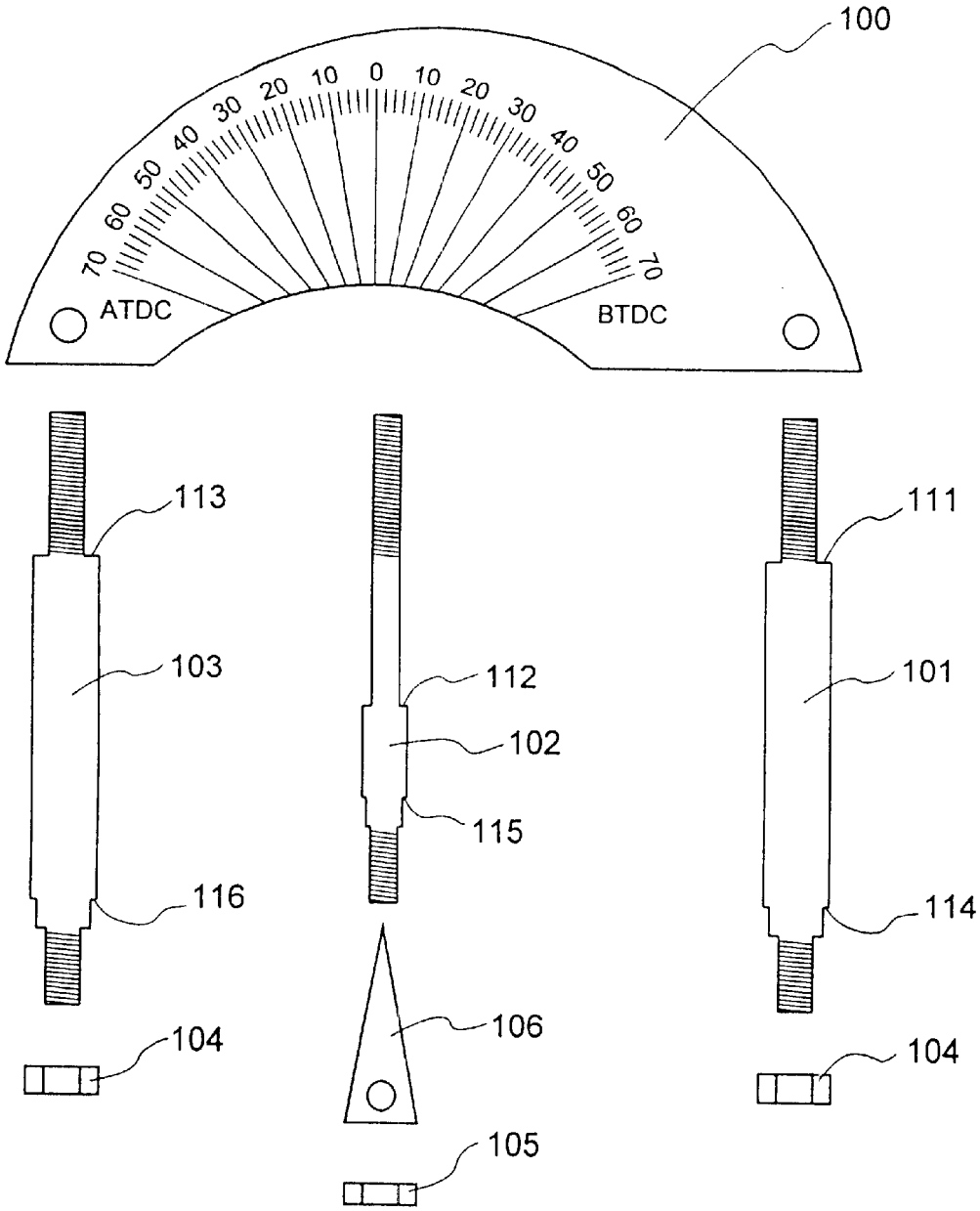
FIG. 3 is a plan view of the components of an embodiment of the invention before installation.

The preferred embodiment of the invention is comprised of an auxiliary ignition timing display tool provided in a kit comprising the components shown in FIG. 3 for temporary installation during the setting of the ignition timing of a Harley-Davidson motorcycle engine or other similar engine. The relationship of the parts of a typical stock Harley-Davidson motorcycle engine gear box circa early 1970's are shown in FIG. 1. The following is a listing of the parts illustrated in FIG. 1 and their associated reference numbers:

1. Oil screen cap
2. O-ring
3. Oil screen spring
4. Oil screen
5. Circuit breaker cover screws (2)
6. Circuit breaker cover
7. Circuit breaker cover gasket
8. Circuit breaker cam assy. Bolt
9. Circuit breaker plate screw (2) (1970)
9A. Circuit breaker plate screw (1971 to 1972)
9B. Circuit breaker plate screw (late 1972 & later)
10. Circuit breaker plate screw lockwasher and washer (1970)
10A. Retainer (1971 to early 1972 )
11. Circuit breaker plate assembly.
12. Circuit breaker cam
13. Circuit breaker advance assembly.
14. Gear cover screw, 1 in (2)
15. Top gear cover screw, 1-¼ in (1)
15*a*. Bottom gear cover screw, 1-¼ in (2)
16. Top gear cover screw, 1-¾in (1)
17. Gear cover (1970–72 )
17A. Gear cover (1973 & later)
18. Gear cover gasket (1970–72 )
18A. Gear cover gasket (1973 & later)
19. Breather gear washer
20. Breather gear
21. Cam gear
22. Cam gear spacing washer
23. Cam gear thrust washer
24. Gear shaft nut
25. Pinion gear (early 1977 & earlier)
25A. Pinion gear (late 1977 & later)
26. Pinion gear key
27. Pinion gear spacer
28. Oil pump pinion shaft gear
29. Oil pump pinion shaft gear key
30. Oil pump drive gear lock ring
31. Oil pump drive gear
32. Oil pump drive gear key
33. Gear cover camshaft bushing
34. Camshaft oil seat
35. Camshaft needle bearing
36. Cover down pin (2)
37. Wire clip
38. Oil line fitting
39. Oil pump shaft
40. Oil line fitting
41. Oil pump shaft FIG. 2 is identical to FIG. 1 except that the parts of the timing display tool have been added to what is illustrated, and the parts of the gearbox of FIG. 1 that must be removed to temporarily install the timing display tool have been omitted. Many of the parts of the gear box are unaffected by the temporary installation of the timing display tool, but are shown in FIGS. 1 and 2 for convenience of graphic exposition.

Figure 4:
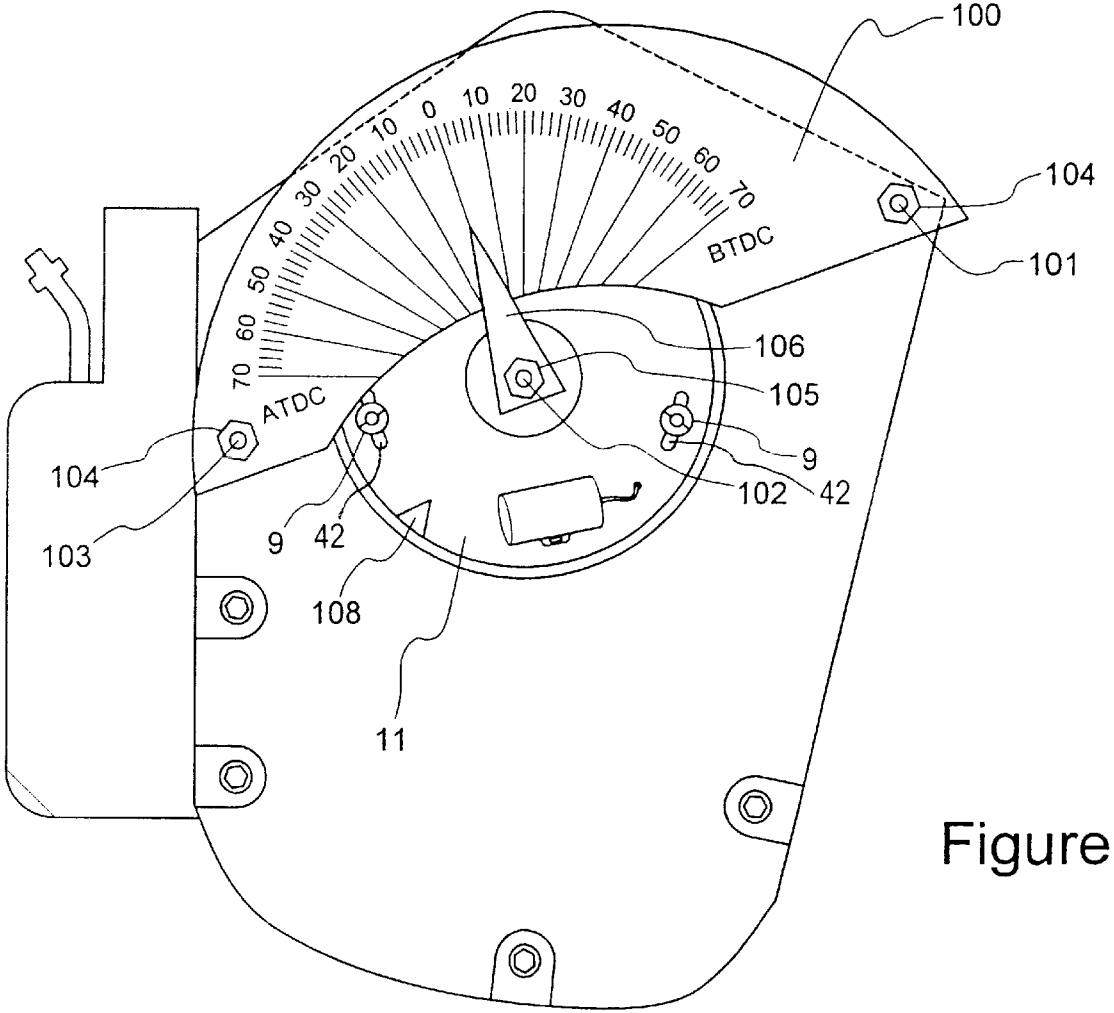
FIG. 4 is a front elevation view of the gearcase of FIG. 2 after installation of the tool shown in FIG. 3 installed.

Generally, the timing display tool provides a means for setting the ignition timing by first removing circuit breaker cover 6, replacing circuit breaker cam assembly bolt 8 with pointer cam bolt 102 by threading the distal end of the pointer cam bolt 102 into the rotatable cam assembly (including cam gear 21 and the removred cam assembly bolt 8), and then attaching pointer 106 to the end of pointer cam bolt 102 with nut 105 Top gear cover screws 15 and 16 are replaced with timing measuring plate fasteners, namely timing measuring plate mounting bolts 101 and 103, respectively. An ignition timing measuring plate 100 is then mounted upon the mounting bolts 101 and 103 using measuring plate mounting nuts 104. The measuring plate 100 features an arcuate scale of degree ignition timing marks between −70 and +70 degrees The piston is rotated until it is placed into its top dead centre (TDC) position and is then stopped at TDC position, then the pointer 106 is adjusted until it points to zero degrees on the scale of the measuring plate 100; and finally, the nut 105 is tightened. The assembled gearbox with the timing display tool installed is shown in FIG. 4. While the engine is running, a strobe timing light (not shown) set to match the spark firing frequency is shone onto the spinning pointer. The position at which the pointer is illuminated on the measuring plate 100 indicates the degree of spark advance or retard. The points plate and advance unit are then adjusted to set the ignition timing as discussed in more detail below.

As shown in FIG. 3, each of the bolts 101, 102, 103 is provided with a central section having a larger diameter than the ends of the bolts 101, 102, 103 so as to provide shoulders 111, 112, 113 at the appropriate distances from the ends of the bolts 101, 102, 103. The bolts 101, 102, 103 are screwed into the threaded openings (not shown) which receive gear cover screw 15, circuit breaker cam bolt 8, and gear cover screw 16. Annular shoulders 111, 112, 113 provide substitutes for the heads of gear cover screws 15, 16 in the case of bolts 101, 103 and the head of circuit breaker cam bolt 8 in the case of bolt 102 so that bolts 101, 102, 103, when tightened, are screwed in the proper distances. Similarly, shoulders 114, 115, 116 are provided for supporting ignition timing measuring plate 100 in the case of shoulders 114, 116 and indicator pointer 106 in the case of shoulder 115. Preferably, the dimensions of bolts 101 and 103 are selected so that when measuring plate 100 is mounted, the measuring plate 100 is spaced slightly in front of the rim of the gear cover 17, 17A, but not too far so that the measuring plate 100 interferes with the rotation of the pointer 106. Preferably, the dimensions of bolt 102 is selected so that pointer 106 does not interfere with the measuring plate and other elements of the ignition unit.

Note that the bolts 101, 102, 103 as shown in FIG. 2 are an oversimplification, and do not illustrate the bolt central sections as clearly as in FIG. 3.

The exemplary timing display tool is installed in the following manner:

1. With the engine off, the spark plugs (not shown) are temporarily removed to ensure easy rotation of the motor.
2. A head screw plug (not shown) is removed from the timing indicator side of the engine case (not shown), exposing a view of the flywheel (not shown); on the flywheel is a top dead centre (TDC) mark of the front cylinder of the motor. Using this mark as a guide, the crankshaft and piston (both not shown) are rotated until they are aligned at the top dead center position.
3. The head screw plug and the spark plugs are reinstalled.
4. The circuit breaker cover screws 5, circuit breaker cover and circuit breaker cover gasket 7 are removed and the circuit breaker cam bolt 8 is removed and replaced with pointer cam bolt 102.
5. Gear cover screws 15 and 16 are then removed and replaced with measuring plate mounting bolts 101, 103 respectively.
6. The ignition timing measuring plate 100 is then mounted onto the mounting bolts 101, 103 and secured with measuring plate mounting nuts 104.
7. Indicator pointer 106 is then mounted on the proximal end of pointer cam bolt 102 and secured with indicator pointer mounting nut 105 such that indicator pointer 106 is aligned with the TDC position on ignition timing measuring plate 100, marked as "0" in FIG. 3. Care must be had to ensure that steps 3 to 7 do not move the piston away from its aligned position at TDC. The indicator point 106 will then rotate with breaker cam 12.

The engine is then started. The strobe timing light (not shown) has a standard inductive pickup which is connected to the ignition system. This enables the strobe timing light frequency to be set to match the spark firing frequency. The strobe timing light is then shone onto the ignition timing measuring plate 100 and the rotating indicator pointer 106. The degree timing mark on the scale of measuring plate 106 at which the pointer 106 is illuminated is the position of the piston at the instant a spark is ignited; in other words, the degree timing mark indicates the degree of spark advance or retard relative to TDC.

The ignition timing is adjusted and set to the desired specifications by loosening circuit breaker plate screws 9, 9A, or 9B (depending on model year) and adjusting the circuit breaker plate 11 in the conventional manner: referring to FIG. 4, once the plate screws 9, 9A, or 9B have been loosened, circuit breaker plate 11 is rotatable through a range defined by arcuate slots 42; this changes the points contact relative to the cam profile on cam 12, thereby altering the timing of the opening and closing of the points contact and thus, the timing of the ignition. Care should be taken not to loosen the plate screws 9, 9A or 9B too much, or else the breaker plate 11 may fall off. The breaker plate 11 is rotated by inserting a screwdriver or like device into slot 108, then cranking the screwdriver a selected angular distance. The screwdriver makes contact with a timing adjustment screw (not shown), which has cam-related engagement with the plate 11 such that fairly modest angular motion of the plate 11 results in a much larger angular adjustment of the retard or advance in the ignition timing Therefore, the arcuate slots 42 occupy a shorter arc-length relative to the range of angular adjustment available of the ignition timing.

After the circuit breaker plate has been rotated by a selected angle, the strobe light may be shone on the measuring plate 100 to determine the degree of timing advance or retard effected by the adjustment. The measuring plate 100 provides a ±70 degree range of adjustment; however, it is within the designer's preference to vary this scale. Generally, the timing of most engines will not be adjusted beyond ±40 degrees, although a 70 degree advance or retard has been known for unusually high performance applications, such as drag racing.

The ignition timing measuring plate 100 is dimensioned and positioned not to interfere with the adjustment of the circuit breaker plate 11. The base of the measuring plate 100 is shaped to provide sufficient clearance away from the parts of the circuit breaker plate 11 that require access during the timing adjustment procedure, such as plate screws 9, 9A and 9B, and indicator pointer bolt 102. Different suitable configurations of the base of the measuring plate 100 are illustrated; in FIG. 2, there are two small arcs disposed along the measuring plate base that permit rotation of the pointer bolt 102 and access to plate screws 9, 9A and 9B, respectively. In FIG. 4, similar access is provided by one large arc spanning the width of the base of the circuit breaker plate 11.

Once the correct timing has been achieved, the plate screws 9, 9A and 9B are tightened, the components of the timing display tool are removed and the original gear case components are re-installed in their original places.

According to an alternative embodiment of the invention, the pointer indicator 106 and pointer cam bolt 102 may be formed as single integral pointer indicator unit (not shown).

According to yet another alternative embodiment of the invention, a pointer indicator unit (not shown) may be releasably attached to the circuit breaker cam assembly bolt 8. This obviates the need to remove the cam assembly bolt 8 from the cam assembly in order to operate the timing display tool. In this connection, the indicator unit has a mounting shaft (not shown) that has a length shorter than the pointer cam bolt 102 but sufficient to provide adequate clearance between the pointer and the gear cover. Conventional clamping mechanisms may be installed at the distal end of the mounting shaft to provide a means for releasable attachment of the pointer indicator unit to the rotating camshaft assembly.

Other modifications will be apparent to those skilled in the art and, therefore, the invention is defined in the claims. For example, the timing display tool may be modified to adjust the timing of motorcycle engines other the Harley Davidsons. Among engine manufacturers for whose engines the invention would be suitable include S&S and Merch Performance. It is apparent that the position of bolt-receiving apertures, the configuration and dimensions of bolts etc. will be different for different engines; routine modifications that enable the timing display tool to be suitably installed on different engines will occur to one skilled in art. Also, while the description above relates primarily to the adjustment of a mechanical points mechanism and advance unit, the invention is not restricted to such an engine timing setting adjustment device and may be. applied to adjust the timing of motors utilizing other types of adjustment devices. Such other adjustment devices may benefit from the invention if the requisite timing information (e.g. TDC and timing marks) are not on the same side of the motor as the ignition timing unit to be adjusted.

What is claimed is:

1. An auxiliary engine ignition timing display tool for use with a strobe timing light in setting the ignition timing of a Harley Davidson™-type motorcycle engine, the engine having an indicator for ignition timing viewable on a timing indicator side of the engine and an engine ignition timing setting adjustment device accessible on a timing adjustment side of the engine, the timing adjustment side of the engine being opposite the timing indicator side of the engine; the engine also including a rotatable cam assembly, a gear cover and an ignition unit, the timing display tool comprising, in combination:

(a) a rotatable pointer cam bolt having a distal end for releasable attachment to the cam assembly;

(b) a pointer indicator for attachment to a proximal end of the pointer cam bolt;

(c) an ignition timing measuring plate which when installed is on the timing adjustment side of the engine said measuring plate having a plurality of ignition timing marks for indicating the degree of spark advance or retard relative to a top dead center position;

(d) measuring plate fasteners for releasably fastening the measuring plate to the engine or gear cover and positioning the measuring plate proximal to the pointer indicator; whereby the measuring plate and pointer indicator in conjunction with the strobe timing light set to the spark firing frequency of the engine are operable to provide an indication of the ignition timing of the engine while the engine is running.

2. The timing display tool of claim 1, packaged for sale as a kit.

3. The timing display tool of claim 1 wherein the pointer indicator and pointer cam bolt are integrally joined as a pointer indicator unit.

4. The timing display tool of claim 1 wherein the pointer cam bolt has at its distal end a clamping means for releasably clamping the pointer cam bolt to the cam assembly.

5. The timing display tool of claim 1 wherein the pointer cam bolt is releasably attachable to a cam assembly bolt of the cam assembly.

6. The timing display tool of claim 1 wherein the pointer cam bolt is threaded at its distal end and proximal ends, and has a wider-diameter cylindrical portion providing an annular shoulder between than distal and proximal ends.

7. The timing display tool of claim 6 wherein the pointer cam bolt is threadable into a cam gear of the cam assembly, after a cam assembly bolt has been removed from the cam assembly.

8. The timing display tool of claim 1 wherein the measuring plate fasteners releasably fasten the measuring plate to the engine gear cover.

9. The timing display tool of claim 8 wherein the measuring plate fasteners include at least one measuring plate mounting bolt having a distal end for attachment to the gear cover, and a proximal end for attachment to the measuring plate.

10. The timing display tool of claim 9 wherein the measuring plate mounting bolt is threaded at its distal and proximal ends and has a wider-diameter cylindrical portion providing an annular shoulder between the distal and proximal ends.

11. An auxiliary engine ignition timing display tool for use with a strobe timing light in setting the ignition timing of a Harley Davidson™-type motorcycle engine, the engine having an indicator ignition timing viewable on a timing indicator side of the engine and an engine ignition timing setting adjustment device accessible on a timing adjustment side of the engine, the timing adjustment side of the engine being opposite the timing indicator side of the engine; the engine also including a rotatable cam assembly, a gear cover and an ignition unit, the timing display tool packaged for sale as a kit and comprising, in combination:

(a) a rotatable pointer indicator unit having a pointer indicator at a proximal end and attachment means at a distal end for releasable attachment to the cam assembly;

(c) an ignition timing measuring plate which when installed is on the timing adjustment side of the engine, said measuring plate having a plurality of ignition timing marks for indicating spark advance or retard relative to a top dead center position;

(d) measuring plate fasteners for releasably fastening the measuring plate to the engine and positioning the measuring plate proximal to the pointer indicator unit;

whereby the measuring plate and pointer indicator unit in conjunction with the strobe timing light set at the spark firing frequency of the engine are operable to provide an indication of the ignition timing of the engine while the engine is running.

12. A timing display tool as defined in claim 11, wherein the ignition timing marks comprise radial lines centered on the pointer axis.

13. An auxiliary engine ignition timing display tool for use with a strobe timing light in setting the ignition timing of a Harley Davidson™-type motorcycle engine having an indicator of ignition timing viewable on a timing indicator side of the engine and an engine ignition timing setting adjustment device accessible on a timing adjustment side of the engine, the timing adjustment side of the engine being opposite the timing indicator side of the engine; the engine also having a gear cover, a housing and a spark plug ignition unit responsive to relative piston position with respect to a top dead center position, the timing display tool packaged for sale as a kit and comprising in combination:

(a) a spark timing display device, removably attachable to the gear cover, which when installed is operatively coupled to the ignition unit for indicating the degree of spark advance or retard relative to top dead center and provides a display of the indication viewable on the timing adjustment side of the engine, said display device being removably attachable to the engine housing; and (b) a plurality of fasteners for releasably fastening the display device to the gear cover and positioning the display device in a preselected position suitable for coupling of the display device to the ignition unit;

whereby the display device in conjunction with the strobe timing light set at the spark firing frequency of the engine are operable to provide an indication of the ignition timing of the engine while the engine is running.

* * * * *